United States Patent [19]

Hanel

[11] 3,955,229

[45] May 11, 1976

[54] RUBBER BOAT

[76] Inventor: Klaus Hanel, Carlsdorfer Strasse 3, 3520 Hofgeismar, Germany

[22] Filed: Feb. 20, 1974

[21] Appl. No.: 443,963

[30] Foreign Application Priority Data

Feb. 20, 1973 Germany ..... 2308357

[52] U.S. Cl. ..... 9/2 A; 9/11 A

[51] Int. Cl.[2] ..... B63B 7/00

[58] Field of Search ..... 9/2 A, 11 A; 114/.5 F

[56] References Cited

UNITED STATES PATENTS

| | | | |
|---|---|---|---|
| 1,620,867 | 3/1927 | Boyle | 9/2 A |
| 1,794,417 | 3/1931 | Nador | 9/2 A |
| 2,413,985 | 1/1947 | Manson et al. | 9/11 A |
| 2,717,849 | 9/1955 | Rempel et al. | 9/2 A |

FOREIGN PATENTS OR APPLICATIONS

| | | | |
|---|---|---|---|
| 1,301,367 | 7/1967 | France | 9/2 A |
| 1,377,554 | 9/1964 | France | 9/2 A |
| 631,771 | 4/1960 | Italy | 9/11 A |
| 254,736 | 6/1927 | United Kingdom | 9/2 A |
| 4,802 | 7/1901 | Austria | 9/2 A |

*Primary Examiner*—Trygve M. Blix
*Assistant Examiner*—Jesus D. Sotelo
*Attorney, Agent, or Firm*—Bruce K. Thomas

[57] ABSTRACT

End wall compartment closures for the stern parts of inflatable sponsons or pontoons for rubber boats are disclosed to enhance the gliding motion or planing action of the boat through the water and prevent distortion of the sponsons under variable inflation pressures while increasing the load carrying capacity and stability of such craft. In the several embodiments each of the elongated tubular sponsons that extend along the sides of a rubber boat is provided with a rigid-non-deformable closure wall that is essentially vertical to the longitudinal axis of the sponson or is in the form of an annular or tubular part or insert in the stern of the sponsons. The tubular inserts can be pot-shaped with circumferential grooves or ribs on the sides and have a bottom wall which forms the end compartment wall or closure wall for the sponson. Provision is made for extendable pressing or compression rods on the inside of a sponson joining and supporting one sponson to another by means of their rigid end wall compartment closures. Such internal expanding rods can be used to allow the sponson to fill up with air from the atmosphere through a valve in the end wall of one of the compartments. The end wall compartment closures at the stern provides for the attachment of eyelets, supports, handles, signal units and trim surfaces as well as airtight valves.

5 Claims, 23 Drawing Figures

RUBBER BOAT

BACKGROUND OF THE INVENTION

It is known in the prior art to provide inflatable rubber boats or rafts with side sponsons that are tapered or pointed at their rear or stern ends. This construction allows undesirable instability which reduces the effectiveness of the driving mechanisms of the boat even before it has reached its gliding or planing speed. Some prior art rubber boats have wedge shaped sterns fastened to the undersides of the supporting sponsons across the stern for the purpose of stability and providing a favorable course or contour between the sponsons and the tapering sections. It has been demonstrated however that particularly in the case of a heavily loaded boat, there results only an inadequate streamlining effect from these stern connections.

In addition, sponson inserts or ring sockets of a different type than sealing or closure connections such as a straight rubber wall have been proposed. Under the influence of inflating pressure the sponsons and rings become constricted causing the rubber wall to arch toward the outside and as a result the streamlining is unfavorable because of the conical contour. With this construction no improvement of the streamlining is obtained even with the sponsons or pontoons that taper to a point.

SUMMARY OF THE INVENTION

The object of the invention is to provide a sponson closure for the sterns of rubber boats to provide favorable streamlining at the contour edges and improve the reaction of pneumatic boats to the action of other outside forces.

The object is attained in inflatable boats by providing a closure at the ends of the supporting sponsons comprising a rigid non-deformable closure or connecting wall or bulkhead at an angle to the longitudinal axis of the supporting sponson. This structure provides a clearly defined contour edge at the stern of the rubber boat which is also not influenced by variable inflation of the supporting sponson. The stern connecting member of the present invention allows the smooth discharge of water thereby so that the boat planes or skims during movement even at low speed. Also, in the case of a heavily loaded boat, the smooth flow of current by the contoured edge according to the invention is maintained, whereby, especially when getting underway, there is an advantageous reduction of suction forces.

It is advantageous to have the stern closure arranged vertical or at right angles to the longitudinal axis of the supporting sponson so that the gunwale fulfills all conditions for the favorable or streamlined flow through the water and at the same time there is favorable pressure distribution on the junction of the ends of the sponsons.

The stern closure can however, be arranged at an incline on an obtuse or acute angle to the longitudinal axis of the sponson. The gunwale may thus be adjusted to the particular type of boat. The degree of inclination of the stern closure wall influences the amount of streamlining obtained.

In this connection, it is advantageous if the stern closures or bulkheads have a step-like or arched form. Furthermore, a deviation of flexing of the rigid closure wall is possible in order to obtain advantages with special types of boats.

It is particularly advantageous if the closing bulkheads possess the same or larger diameters than the sponsons when in the inflated condition. With closing bulkheads of larger diameter the stern load capacity of the rubber boat can be increased, since the volume of the sponsons increases conically at the stern.

The sealing off compartments or closure bulkheads can advantageously be designed as annular, tubular or sleeve members which are inserted inside the ends of the sponsons. In this case, the sponson ends cannot become constricted or be drawn toghther even if the closure wall or bulkhead consists only of rubber material. This also produces a sharp or pointed gunwale edge at the stern portion of the rubber boat. Any expansion of the sponson during inflation is compensated for by the expansion of the ring, annular or tubular part through tensioning or by choosing a ring or annular part of a larger diameter.

The ring together with the closure bulkhead may advantageously be designed in the form of a disc, be pan-shaped or may have flanges or grooves around the outer circumference. This structure improves the seal and fastening against the inside surface of the sponsons.

In another embodiment the sponson end closure can be clamped between two correspondingly shaped or tapering interlocking rings to produce a gunwale construction suitable for less expensive boats.

With the closure wall connections of this invention it is particularly avantageous to provide on their exterior sides various connections for accessories, such as supports, holding means, eyelets, grips, valves, bolting means, adjustment mechanisms and the like. The attachment of these accessory connections is made simple by the fact of the rigidity of the stern closure walls or bulkheads, in contrast to the conventional rubber boats where the fastening of loops, grips and the like on the sponsons always introduces problems.

Another feature of the invention is the provision of airtight flap valves in the sponsons whereby additional storage space to accommodate articles is produced. Preferably, the closure compartments or bulkheads have a cross sectional shape or area which deviates from the cross sectional shape or area of the sponson. Upon inflation of the sponson they adapt themselves to the cross sectional shape of the closure compartments or bulkheads. Thus, depending on the type of boat the most advantageous closure wall shape can be selected.

The rigid closure walls or bulkheads are glued, cemented or vulcanized to the sponsons. Likewise, clamping, tensioning, riviting and fusing to the sponsons can be used with advantage.

One or more of the closure bulkheads can be tensed or clamped by means of a pressure rod using a knee lever or a toggle locking means for locking the rod on the inside of the sponsons. Thus, the rigidity of the sponson is increased which is of particular advantage in transporting an inflated boat.

DESCRIPTION OF THE DRAWINGS

The invention is more precisely described by reference to the accompanying description and drawings wherein.

DESCRIPTION OF THE PREFERRED EMBODIMENT

Figure 1:
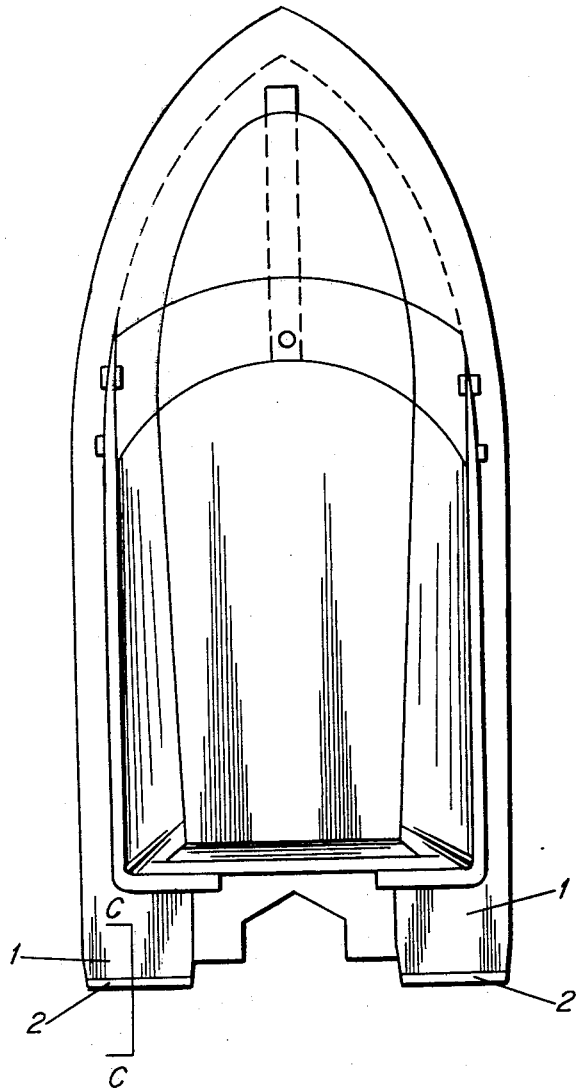
FIG. 1 is a top plan view of a rubber boat having supporting side sponsons.

In FIG. 1, a plan view of a sponson-equipped boat having inflatable, elongated side sponson members 1 extending from the bow to the stern with each having an end closure wall or stern bulkhead 2 thereacross in accordance with this invention.

Figure 1A:
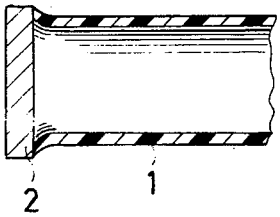
FIG. 1*a* is a fragmentary cross-sectional view taken along the longitudinal axis of a sponson through the stern bulkhead of this invention with the sponson in deflated condition, i.e. along the lines *c*—*c* of FIG. 1.
Figure 1B:
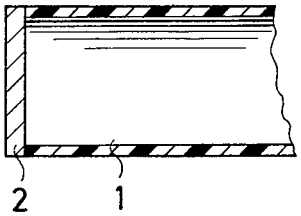
FIG. 1*b* is a view like FIG. 1*a* with the sponson in inflated condition.

FIGS. 1*a* and 1*b* show the tubular supporting sponson 1, on one side of the boat of FIG. 1, having the rigid stern member 2 closing the end of the sponson, before and after inflating. The cross sectional configuration (surface area) of the closure compartment wall or stern member 2 is greater than the main body of the sponson before inflation as shown in FIG. 1*a*. Upon inflating the sponson the latter increases in its cross-sectional area, as shown in FIG. 1*b* so that after inflation the circular walls of the sponson stretch or expand to conform with the cross sectional area of the stern member 2 and a smooth line or juncture between these walls and the periphery of the stern member 2 results. Since the stern member 2 is made of rigid non-deformable material, there is produced a clearly defined smooth contour edge gunwale or juncture at the stern of the rubber boat, which produces favorable flow characteristics against the water.

It is advantageous to provide a still larger cross-sectional surface configuration for the stern closure or wall 2 in relation to the cross-sectional configuration of the sponson in FIGS. 1*a* or 1*b* whereby to produce a stern connection which increases rearwardly or is slightly conical or of increasing shape. This gunwale thereby has increased bouyancy and will support heavier loads.

Figure 2A:
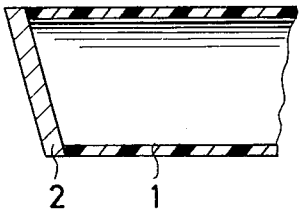
FIG. 2*a* is a view like FIG. 1*a* of a stern bulkhead arranged in an obtuse angle to the longitudinal axis of the sponson.
Figure 2B:
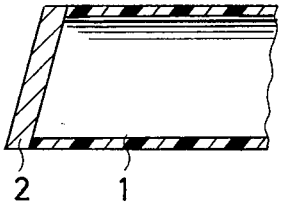
FIG. 2*b* is a view like FIG. 1*a* of a stern bulkhead arranged in an acute angle to the longitudinal axis of the sponson.

FIGS. 2*a* and 2*b* show that the stern closure member 2 for the sponson 1 can be arranged either at an obtuse or acute angle to the longitudinal axis of the supporting sponson. These embodiments are used depending on the type of boat, in order to break the surging water with a favorable (smooth) contour edge.

Figure 3A:
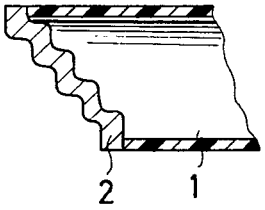
FIGS. 3*a*, 3*b* and 3*c* show, respectively, a stern bulkhead which is stepped or corrugated, arched inwardly and offset angularly.
Figure 3B:
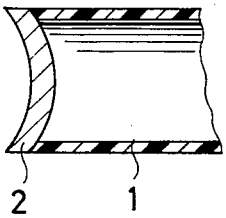
Figure 3C:
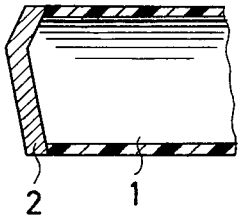

The embodiments shown in FIGS. 3*b* and 3*c* also bring about these advantages. According to the type of boat, for example, a sailing boat, motor boat or a row boat, the shape of the stern connecting member 2 may be selected for different load capacities while at the same time providing favorable gunwale contour and hull contact with the water. Naturally, combinations of the shapes of the stern connecting members 2 can be used, in order, for example, in the case of a multi-purpose boat, to attain most favorable planing or flow characteristics of the boat through the water.

Figure 4A:
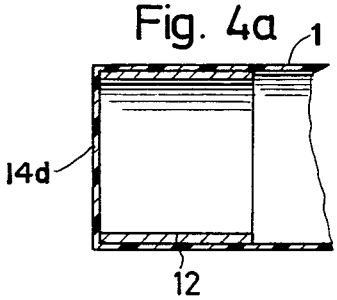
FIGS.4*a* and 4*b* show, respectively, end closures in the form of tubular inserts of relatively long thin wall and short thick wall configuration.
Figure 4B:
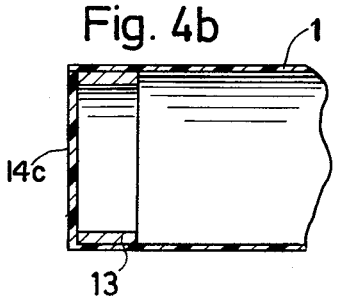

It is seen from FIGS. 4*a* and 4*b* that the end closure can be in the form of a sleeve or tubular part 12 or a ring 13, of shorter and thicker construction inserted in the end of a sponson, in order to sharpen the end contour edge thereof. As these members are constructed of rigid material there is no danger of the ends of the sponsons becoming interlaced or fouling upon inflation and offset the formation of a streamlined contour edge. As shown in FIGS. 4*a* and 4*b* the sponsons have an end wall of non-rigid material. By the choice of an annular or tubular insert of larger diameter as the bulkhead, after inflation of the sponson, there is produced a smooth running juncture between the sponson and its stern. If the diameter of the tubular parts 12 and 13 are made even larger, there results a stern configuration which is enlarged conically and utilized for rubber boats of greater load capacity at the stern end of the boat.

Figure 5A:
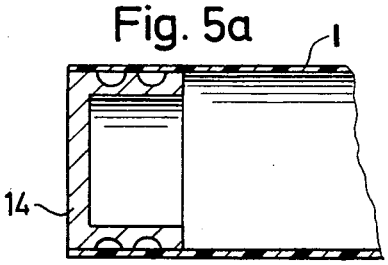
FIG. 5*a* shows a pot or cup-shaped stern bulkhead having circumferential grooves about its side wall.
Figure 5B:
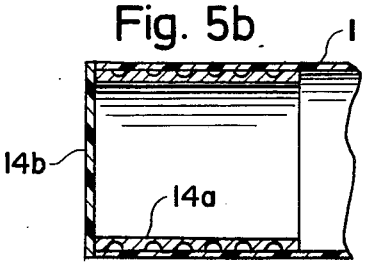
FIG. 5*b* shows an elongated tubular reinforcing insert for the end portion of a pontoon, same having a plurality of smaller grooves about its outer surface.

As shown in FIGS. 5*a* and 5*b* alternate peripheral grooves and flanges or ribs are arranged at the outer circumference of the rigid stern closure parts 14 and 14*a*. As shown in FIG. 5*a*, the annular or tubular portion 14 can be pot-shaped having its own rigid end wall transom or bulkhead, while the tubular part 14*a* is open-ended and an end wall 14*b* is provided thereover to seal the compartment. As shown in FIG. 4*a*, the end wall 14*d* is integral with the side walls of the sponson 1, in FIG. 4*b* the end wall 14*c* is integral with only the bottom of the side wall of the sponson 1, while in FIG. 5*b* the end wall 14*b* is a separate member.

Figure 6A:
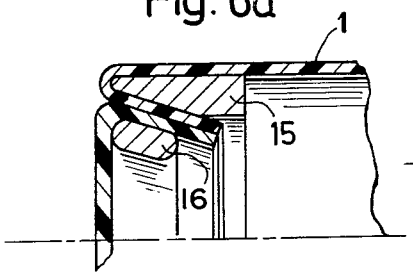
FIG. 6*a* shows an end closure for a pontoon including a pair of concentric clamping rings having the inwardly directed circumferential edges of the sponson fabric and a closure disc locked therebetween.

FIG. 6*a* shows that a pair of tapered, shaped rings 15 and 16 can be used for clamping the end edges of the wall of the sponson 1 with the outer edges of a closure plate or member. This structure to form a contoured streamlined end edge can be used to good advantage, especially in the construction of less expensive boats.

Figure 6B:
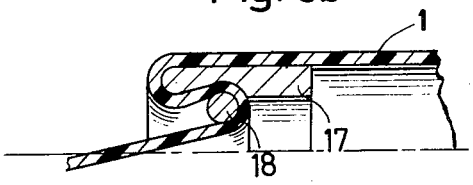
FIG. 6*b* shows an end closure for a pontoon having an internally grooved rigid tubular insert with an O-ring member locking the circular end portion of the sponson therebetween.

Just as satisfactory is the clamping or interlocking arrangement using the two rings 17 and 18 with the interlocking of the sponson material therebetween as shown in FIG. 6*b*. This arrangement can be simply effected and can also be opened or disconnected again when necessary.

Figure 7A:
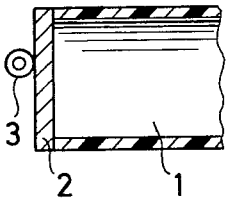
FIGS. 7*a*, 7*b*, 7*c*, 8*a* and 8*b* show, respectively, end closure bulkheads for sponsons having an eyelet, supports, grips, a trim flap and an airtight flap valve therein.
Figure 7B:
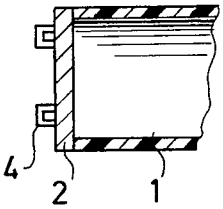
Figure 7C:
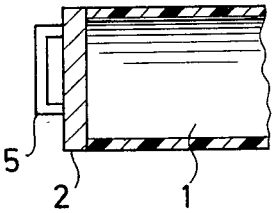

FIGS. 7*a*, 7*b* and 7*c* show how the rigid bulkhead closures 2 may be provided with any desired connections or attachments such as the eyelets 3 for attaching a water ski, rope, the holding means 4 for use to attach wheels, the handles 5, or valves, and flag mountings and the like. In contrast to conventional rubber boats the attachment of such parts on the solid closure bulkheads presents no difficulty.

Figure 8A:
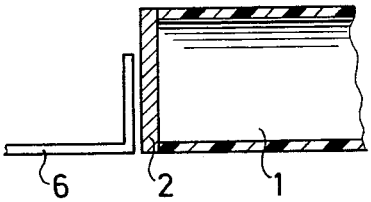

FIG. 8*a* shows that the closure 2 may also have holders or holding devices for trim members 6 or other supporting surfaces whereby an adjusting mechanism (not shown) including locking means and the like may be attached to the solid end wall 2.

Figure 8B:
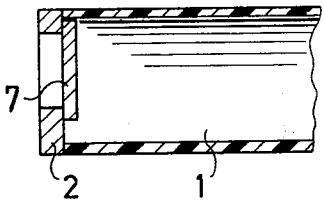

In FIG. 8*b* a closure end wall 2 for the sponson 1 is shown having an airtight (non-return) flap valve 7 therein. Before inflation, objects can be accommodated in the sponsons, such as those used to transport the boat or covering parts that are required after the boat has been in use.

Figure 9A:
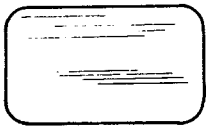
FIGS. 9*a*, 9*b* and 9*c* are end plan views to illustrate various cross-sectional configurations for the closure bulkheads.
Figure 9B:
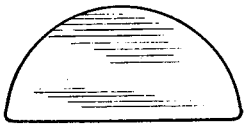
Figure 9C:
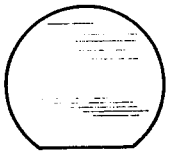

FIGS. 9*a*, 9*b* and 9*c* show a few possible embodiments of the cross-sectional shape of the closure bulkheads. The round inflated supporting sponson is adapted for closure members corresponding to these cross-section forms. The end closures or bulkheads can be designed for and provided with coupling devices so that another boat may be connected to such a rubber boat. The closure bulkheads can also be designed to provide support for an outboard motor.

Figure 10:
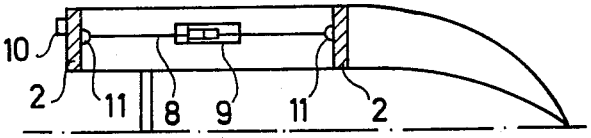
FIG. 10 is a partial cross-sectional view of one half of a boat to show the use of a compression (expandable) rod between a stern bulkhead and an intermediate bulkhead, for tensioning the closure compartment longitudinally.

FIG. 10 shows an embodiment in which the spaced closure bulkheads 2 are provided with the extendable pressure rod 8 on the inside of the sponson. The pressure rods 8 are affixed to the closure bulkheads 2 by means of the joints 11 and are clamped against one another through the toggle fastener 9 in extended position. The toggle fastener 9 is better described as a tension lock which includes a knee lever (not shown). By operating the lever of the toggle lock the tie rods 8 are extended longitudinally against their respective joints 11 and the end closure bulkhead 2 and the front bulkhead 2 are separated from each other and braced. In addition to the already mentioned streamlined contour of the gunwale of the stern of the boat, this embodiment also provides a greater stability to the sponsons which is an advantage in transporting the boat. In addition, during the tensioning (extension) of the rods 8 and clamping by means of the toggle fastener, the compartment between the closure bulkheads is automatically inflated with air, so that a large part of the work of inflation can be dispensed with, for, the air flows in through the valve 10 communicating through the rear bulkhead 2.

By means of the rigid closure bulkhead provided according to the invention an essential improvement of the attitude or position of the boat in the water is attained, with favorable flow form or steamlining of the stern of the boat as it passes upon the water. The firm (rigid) stern construction of the invention herein disclosed allows the water to pass smoothly thereby, and, in an experimental boat it has been shown that the gliding or planing speed of the boat can be even lower through the support of these stern braces or connecting members, as opposed to the prior art boats with the connecting members hitherto employed.

Likewise, upon starting the boat upon the water even before it is in a gliding or planing attitude, the favorable water run-off or streamlining of the transom or stern, during the introduction of outside forces upon the boat are increased in effectiveness. Thus, a sailing boat with the construction of this invention glides through the water under a wind strength not possible with other boats.

What is claimed is:

1. An inflatable rubber boat including:

an elongated inflatable sponson member defined by a flexible tubular wall;

a rigid bulkhead member at the stern end of said sponson, adapted to provide radial support for said tubular wall;

an opening in said bulkhead member communicating with the inside of said sponson; and a one-way flap valve member extending across and enclosing the inside of said opening whereby storage access is provided to the inside of said sponson, said flap valve member preventing the escape of pressurized gas therein;

said bulkhead member extending transverse the longitudinal axis of said sponson member and having an effective diameter that is greater than the uninflated diameter of said sponson whereby upon inflation of said sponson said flexible wall extends to form a smooth coextensive and streamlined contour with the periphery of said bulkhead.

2. An inflatable rubber boat in accordance with claim 1 in which:

a second rigid bulkhead member is provided inside said tubular wall of said sponson and being spaced longitudinally of said first rigid bulkhead member;

an extendable member is connected between said first and second bulkhead members; and means operatively associated with said extendable member to extend and retract same whereby upon actuation of said extendable member to its extended position air passes through said valve member to occupy the increased internal volume created by said extension.

3. An inflatable rubber boat including:

an elongated inflatable sponson member defined by a flexible tubular wall and an enclosing rear wall;

a rigid open-ended tubular member at the stern end of said sponson and having one end in juxtaposition to said enclosing rear wall;

said tubular member extending along the longitudinal axis of said sponson and adapted to provide radial support for said flexible tubular wall at said stern end;

the effective diameter of said tubular member being greater than the uninflated diameter of said sponson whereby upon inflation of said sponson said flexible wall extends to form a smooth, coextensive and streamlined contour with the periphery of said tubular member.

4. An inflatable rubber boat in accordance with claim 3 in which:

the diameter of said bulkhead member is sufficiently larger than the uninflated diameter of said sponson that upon inflation said sponson has a gradually increasing diameter and buoyancy toward said bulkhead member.

5. An inflatable rubber boat in accordance with claim 3 in which:

said rigid tubular member has a circumferential groove about its inner periphery; and an O-ring member is provided which is insertable against the outside of said enclosing rear wall to clamp within said circumferential groove and lock said enclosing rear wall thereabout.

* * * * *